US010016035B2

(12) United States Patent
Kraeling et al.

(10) Patent No.: US 10,016,035 B2
(45) Date of Patent: Jul. 10, 2018

(54) ACCORDION BAG

(71) Applicant: ORBIS Corporation, Oconomowoc, SC (US)

(72) Inventors: Brett Kraeling, Piedmont, SC (US); Ramsey Parry, Piedmont, SC (US)

(73) Assignee: ORBIS Corporation, Oconomowoc, WI (US)

( * ) Notice: Subject to any disclaimer, the term of this patent is extended or adjusted under 35 U.S.C. 154(b) by 37 days.

(21) Appl. No.: 15/134,857

(22) Filed: Apr. 21, 2016

(65) Prior Publication Data

US 2016/0325884 A1 Nov. 10, 2016

Related U.S. Application Data

(60) Provisional application No. 62/156,926, filed on May 5, 2015.

(51) Int. Cl.
*A45C 7/00* (2006.01)

(52) U.S. Cl.
CPC ..... *A45C 7/0077* (2013.01); *A45C 7/0036* (2013.01)

(58) Field of Classification Search
CPC ..... B65D 5/0005; B65D 5/36; B65D 5/3628; B65D 37/00; B65D 27/08; B65D 11/18; B65D 11/1806; B65D 11/1813; B65D 11/182; B65D 11/1826; B65D 11/1833; B65D 11/184; B65D 11/1846; B65D 11/1853; B65D 11/186; A45C 3/02; A45C 7/0077; A45C 7/0059; A45C 7/0063; A45C 13/26; B42F 7/00; B42F 7/02; B42F 7/025; B42F 7/04; B42F 7/06; B42F 7/065; B42F 7/08; A45F 5/12; A45F 2005/125
USPC .... 206/170, 216, 232, 774, 736, 307.1, 425; 383/17–20, 120, 2, 127, 74–74, 76, 77, 383/42, 6, 14, 16; 190/900–902; 220/666; 229/67.1–67.4; 224/575, 586; 150/108
See application file for complete search history.

(56) References Cited

U.S. PATENT DOCUMENTS 61,467 A * 1/1867 Rose ..... B65D 33/001 383/100
554,574 A * 2/1896 Bennett ..... B24F 17/02 206/425
919,745 A * 4/1909 McCraw ..... B65D 33/10 383/2
930,835 A * 8/1909 Brown ..... B65D 5/36 229/112

(Continued)

*Primary Examiner* — Jes F Pascua
*Assistant Examiner* — Nina Attel
(74) *Attorney, Agent, or Firm* — Greensfelder, Hemker & Gale, P.C.

(57) ABSTRACT

A collapsible shipping bag includes a body defining an interior, the body including a top wall, a bottom wall, a right sidewall, and a left sidewall. The collapsible shipping bag further includes a plurality of inner stiffener panels disposed within the interior and dividing the interior into a plurality of pockets, each of the plurality of inner stiffener panels defining an intersection with the top wall and the bottom wall. The collapsible shipping bag further includes a strap coupled to the body at a first plurality of intersections with the top wall and uncoupled from the body at a second plurality of intersections with the top wall. The body is movable from an expanded position to a collapsed position due to movement of the straps.

18 Claims, 12 Drawing Sheets

(56) References Cited

U.S. PATENT DOCUMENTS

| | | | | |
|---|---|---|---|---|
| 1,767,274 | A * | 6/1930 | Broderick | B65D 31/10 383/120 |
| 8,220,873 | B2 * | 7/2012 | Kemp | A47C 7/021 297/217.1 |
| 8,978,912 | B1 | 3/2015 | Kraeling | |
| 2001/0031104 | A1 * | 10/2001 | Vazquez | A45C 7/0063 383/2 |
| 2003/0080125 | A1 * | 5/2003 | Cassani | B60R 7/02 220/6 |
| 2003/0226730 | A1 * | 12/2003 | Platte, III | A45C 3/02 190/103 |
| 2004/0081373 | A1 * | 4/2004 | Nykoluk | A45C 3/00 383/2 |
| 2006/0022479 | A1 * | 2/2006 | Mulvihill | B60R 7/02 296/37.16 |
| 2007/0194090 | A1 * | 8/2007 | Chou | A45C 3/02 229/67.3 |
| 2012/0000912 | A1 * | 1/2012 | Potts | A45C 7/0022 220/553 |
| 2013/0206800 | A1 * | 8/2013 | Simonsen | A45F 5/00 224/148.3 |
| 2014/0246393 | A1 * | 9/2014 | Sabounjian | A47B 43/003 211/118 |

* cited by examiner

ACCORDION BAG

PRIORITY CLAIM

This application claims priority to U.S. Provisional Patent Application Ser. No. 62/156,926, filed May 5, 2015 and entitled "Accordion Bag", and which is incorporated by reference in its entirety herein.

FIELD OF THE INVENTION

The present disclosure relates generally to collapsible shipping bags and methods for collapsing shipping bags, and more particularly to accordion-style collapsible shipping bags.

BACKGROUND OF THE INVENTION

Shipping bags are utilized in a variety of industries, such as for shipping components to manufacturers or for downstream assembly. One particular industry in which shipping bags are utilized is the automotive industries. Components such as car door, panels, etc. can be loaded into protective bags for shipping, and shipped to the next company in the supply chain for manufacture of the automobile.

Once components being shipped in a shipping bag are received and unloaded from the shipping bag, it may be desirable for the shipping bag to be stored or returned for reuse. Accordingly, it is desirable for such shipping bags to be collapsible to facilitate such storage or return. Improved collapsible shipping bags are thus desired in the art.

BRIEF DESCRIPTION OF THE INVENTION

Aspects and advantages of the invention will be set forth in part in the following description, or may be obvious from the description, or may be learned through practice of the invention.

In accordance with one embodiment, a collapsible shipping bag is provided. The collapsible shipping bag includes a body defining an interior, the body including a top wall, a bottom wall, a right sidewall, and a left sidewall. The bottom wall is spaced from the top wall along a vertical axis. The right sidewall and left sidewall each extend between the top wall and the bottom wall. The left sidewall is spaced from the right sidewall along a longitudinal axis. The collapsible shipping bag further includes a plurality of inner stiffener panels disposed within the interior and dividing the interior into a plurality of pockets, each of the plurality of inner stiffener panels defining an intersection with the top wall and the bottom wall. The collapsible shipping bag further includes a strap coupled to the body at a first plurality of intersections with the top wall and uncoupled from the body at a second plurality of intersections with the top wall. The body is movable from an expanded position to a collapsed position due to movement of the straps. Movement of the straps to move the body from the expanded position to the collapsed position causes movement of the first plurality of intersections in a first direction along the vertical axis and movement of the second plurality of intersections in a second opposite direction along the vertical axis.

In accordance with another embodiment, a collapsible shipping bag is provided. The collapsible shipping bag includes a body defining an interior, the body including a top wall, a bottom wall, a right sidewall, a left sidewall and a rear wall. The bottom wall is spaced from the top wall along a vertical axis. The right sidewall and left sidewall each extend between the top wall and the bottom wall. The left sidewall is spaced from the right sidewall along a longitudinal axis. The rear wall is releasably connectable to one of the left sidewall or right sidewall and rotatably connected to the other of the left sidewall or right sidewall, and is rotatable about the vertical axis. The collapsible shipping bag further includes a plurality of inner stiffener panels disposed within the interior and dividing the interior into a plurality of pockets, each of the plurality of inner stiffener panels defining an intersection with the top wall and the bottom wall. The collapsible shipping bag further includes a strap coupled to the body at a first plurality of intersections with the top wall and uncoupled from the body at a second plurality of intersections with the top wall. The first plurality of intersections with the top wall and the second plurality of intersections with the top wall are disposed in an alternating arrangement. The body is movable from an expanded position to a collapsed position due to movement of the straps. Movement of the straps to move the body from the expanded position to the collapsed position causes movement of the first plurality of intersections in a first direction along the vertical axis, movement of the second plurality of intersections in a second opposite direction along the vertical axis, and movement of one of the right sidewall or the left sidewall towards the other of the right sidewall or the left sidewall along the longitudinal axis.

In accordance with another embodiment, a method for collapsing a shipping bag is provided. The shipping bag includes a body defining an interior, the body including a top wall, a bottom wall, a right sidewall, and a left sidewall, the bottom wall spaced from the top wall along a vertical axis, the right sidewall and left sidewall each extending between the top wall and the bottom wall, the left sidewall spaced from the right sidewall along a longitudinal axis. The shipping bag further includes a plurality of inner stiffener panels disposed within the interior and dividing the interior into a plurality of pockets, each of the plurality of inner stiffener panels defining an intersection with the top wall and the bottom wall. The method includes moving a first plurality of intersections with the top wall in a first direction along the vertical axis, and moving a second plurality of intersections with the top wall in a second direction opposite the first direction along the vertical axis. Movement of the first plurality of intersections with the top wall and the second plurality of intersections with the top wall causes movement of one of the right sidewall or the left sidewall towards the other of the right sidewall or the left sidewall along the longitudinal axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
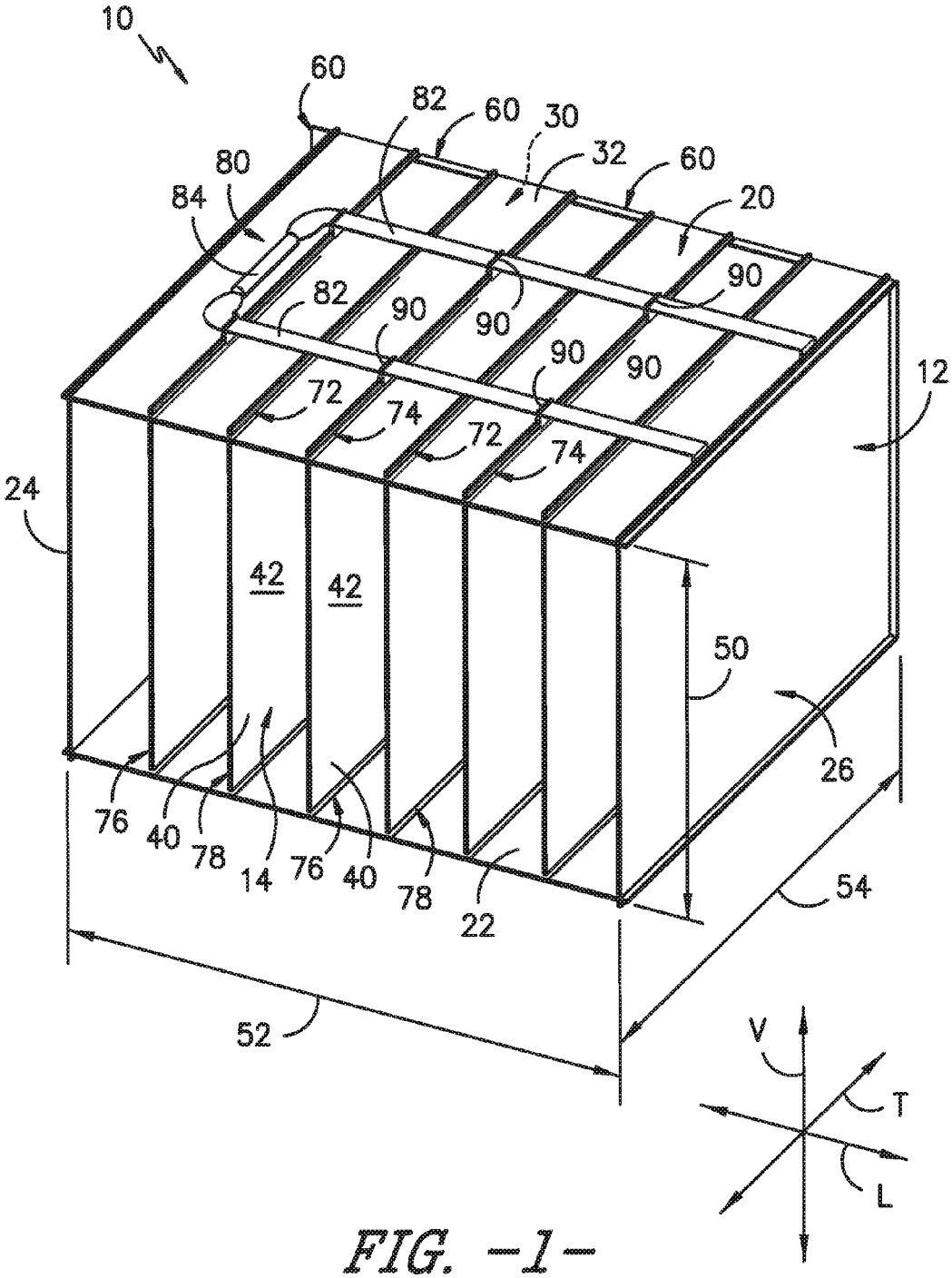
FIG. 1 is a perspective view of a collapsible shipping container in an expanded position in accordance with embodiments of the present disclosure.
Figure 2:
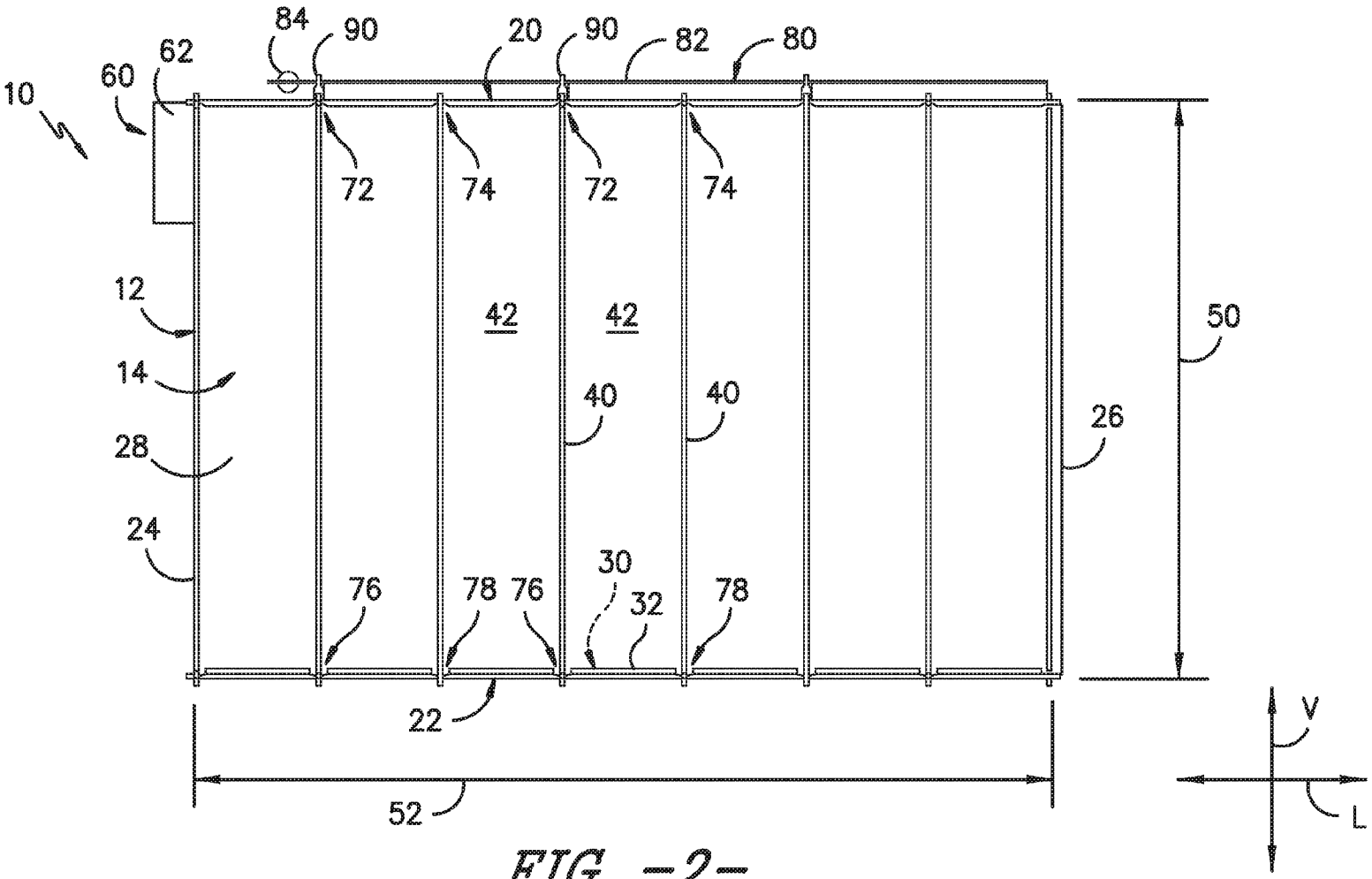
FIG. 2 is a front view of a collapsible shipping container in an expanded position in accordance with embodiments of the present disclosure.
Figure 3:
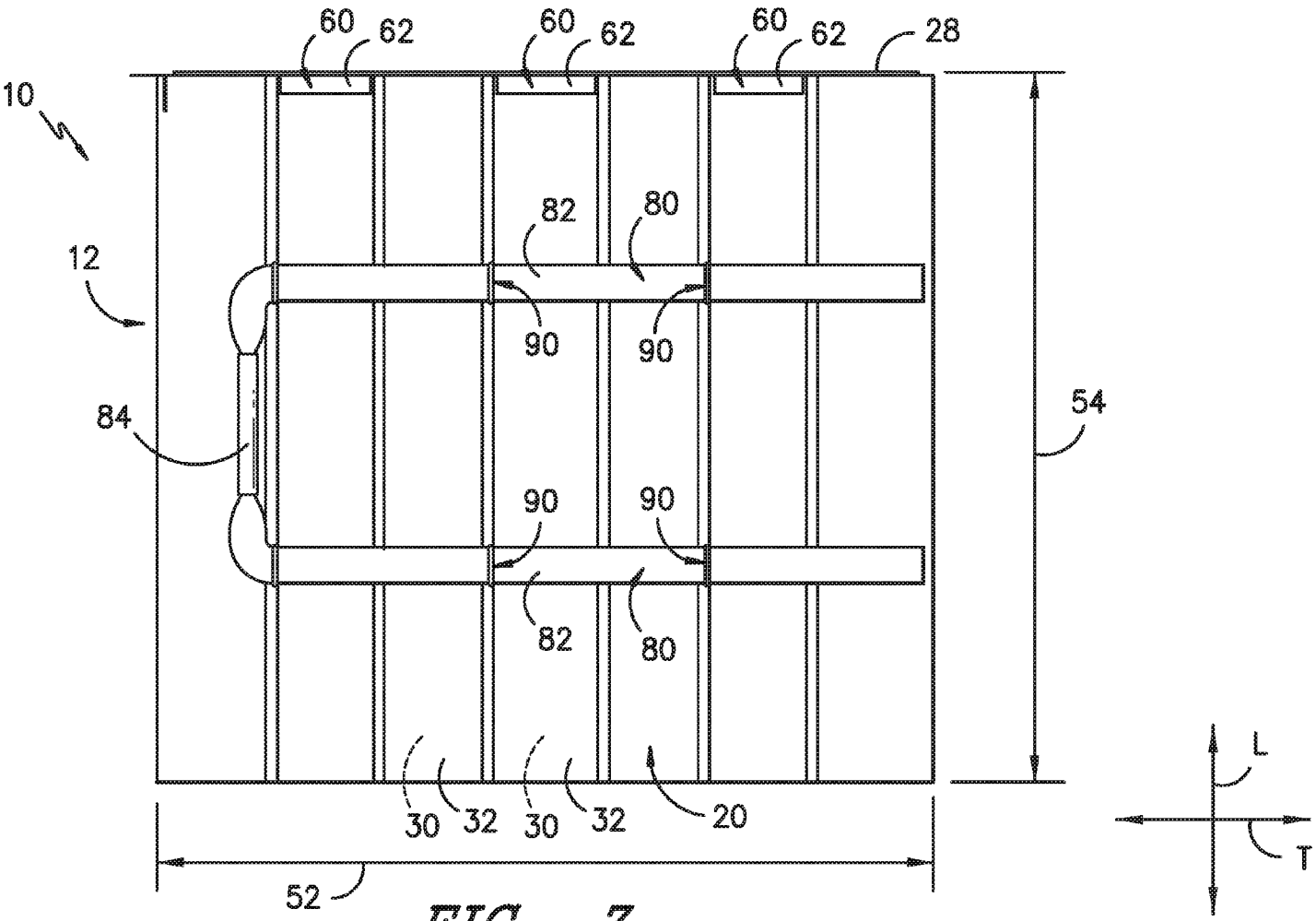
FIG. 3 is a top view of a collapsible shipping container in an expanded position in accordance with embodiments of the present disclosure.
Figure 4:
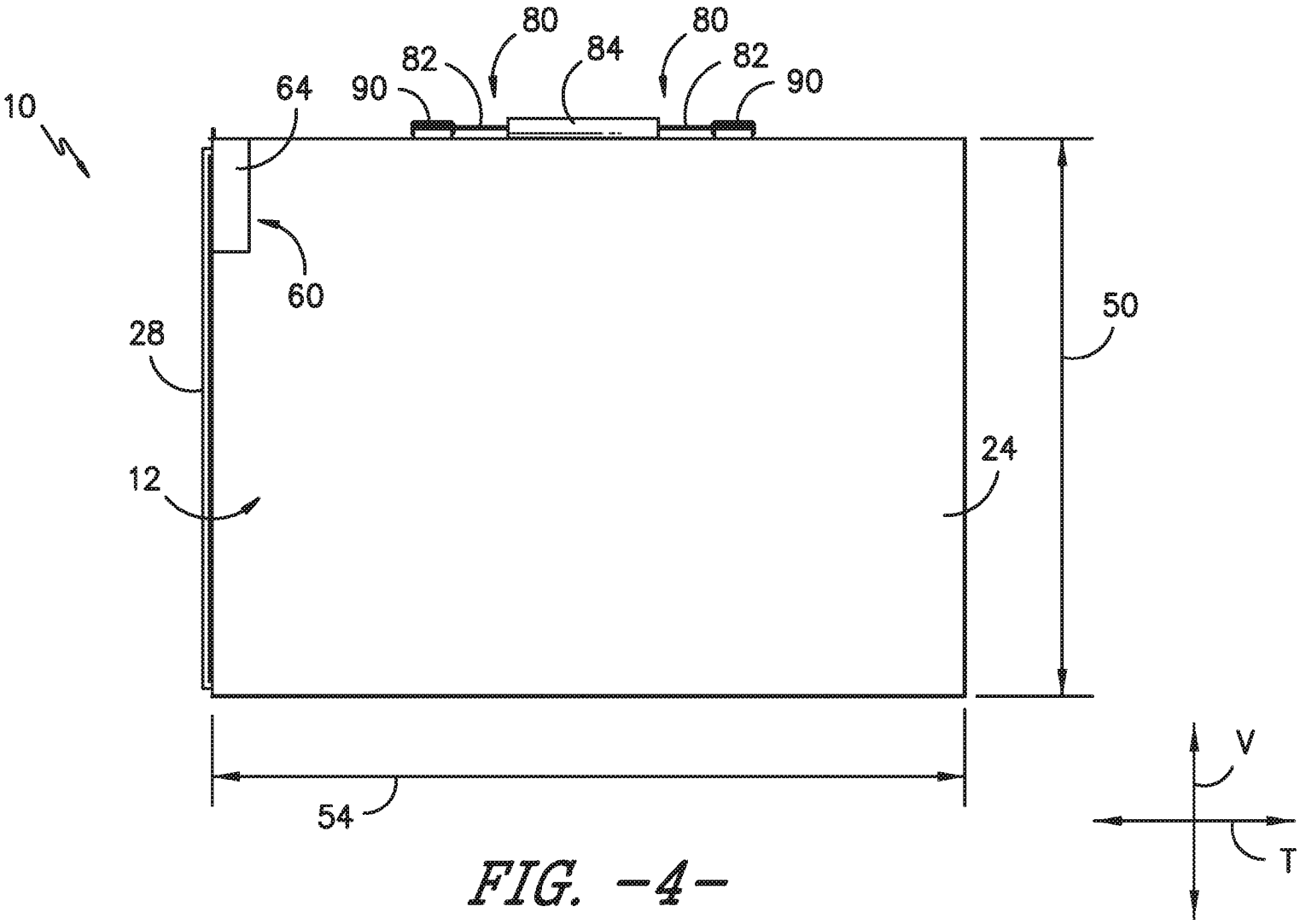
FIG. 4 is a left side view of a collapsible shipping container in an expanded position in accordance with embodiments of the present disclosure.
Figure 5:
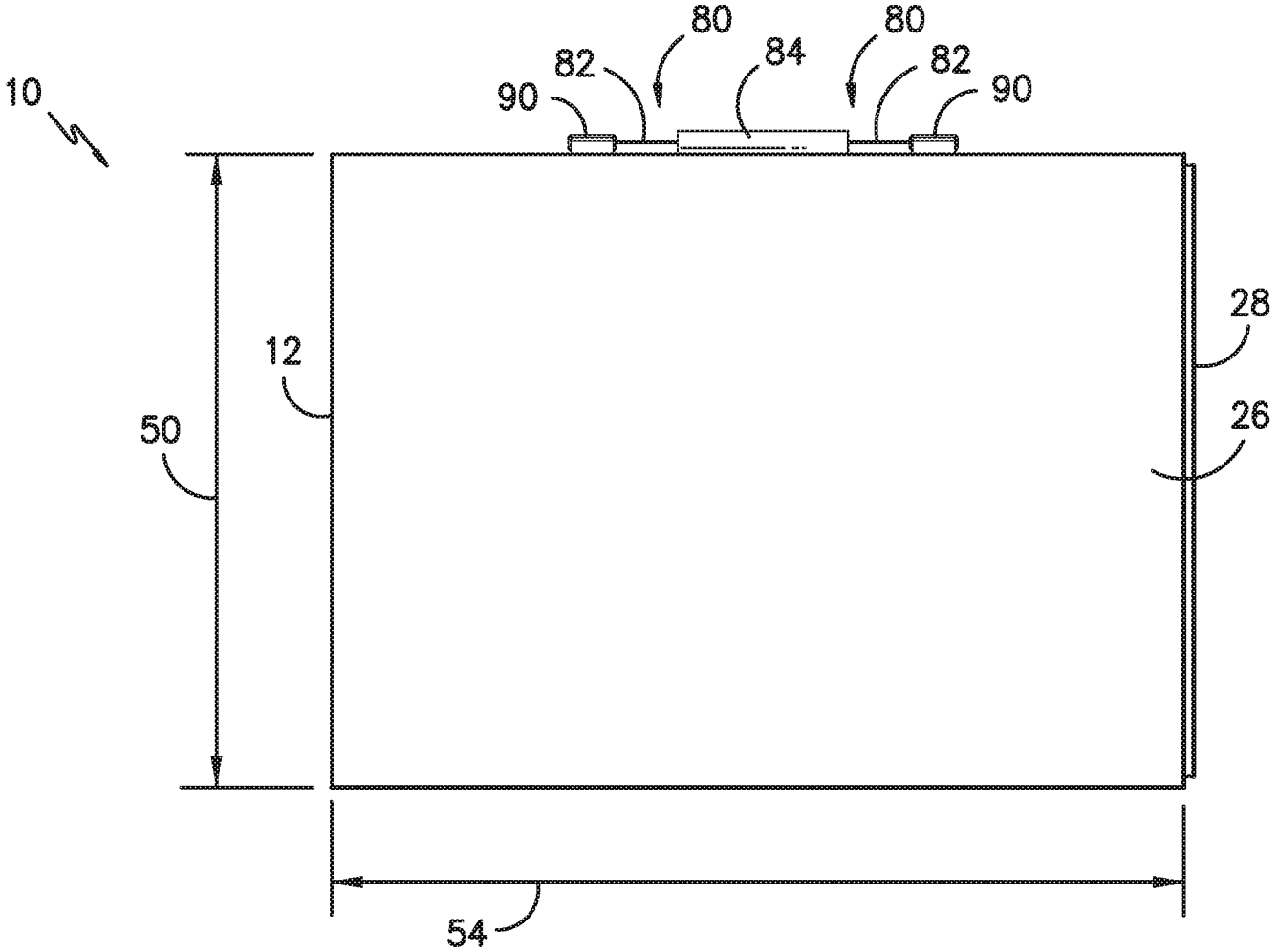
FIG. 5 is a right side view of a collapsible shipping container in an expanded position in accordance with embodiments of the present disclosure.
Figure 6:
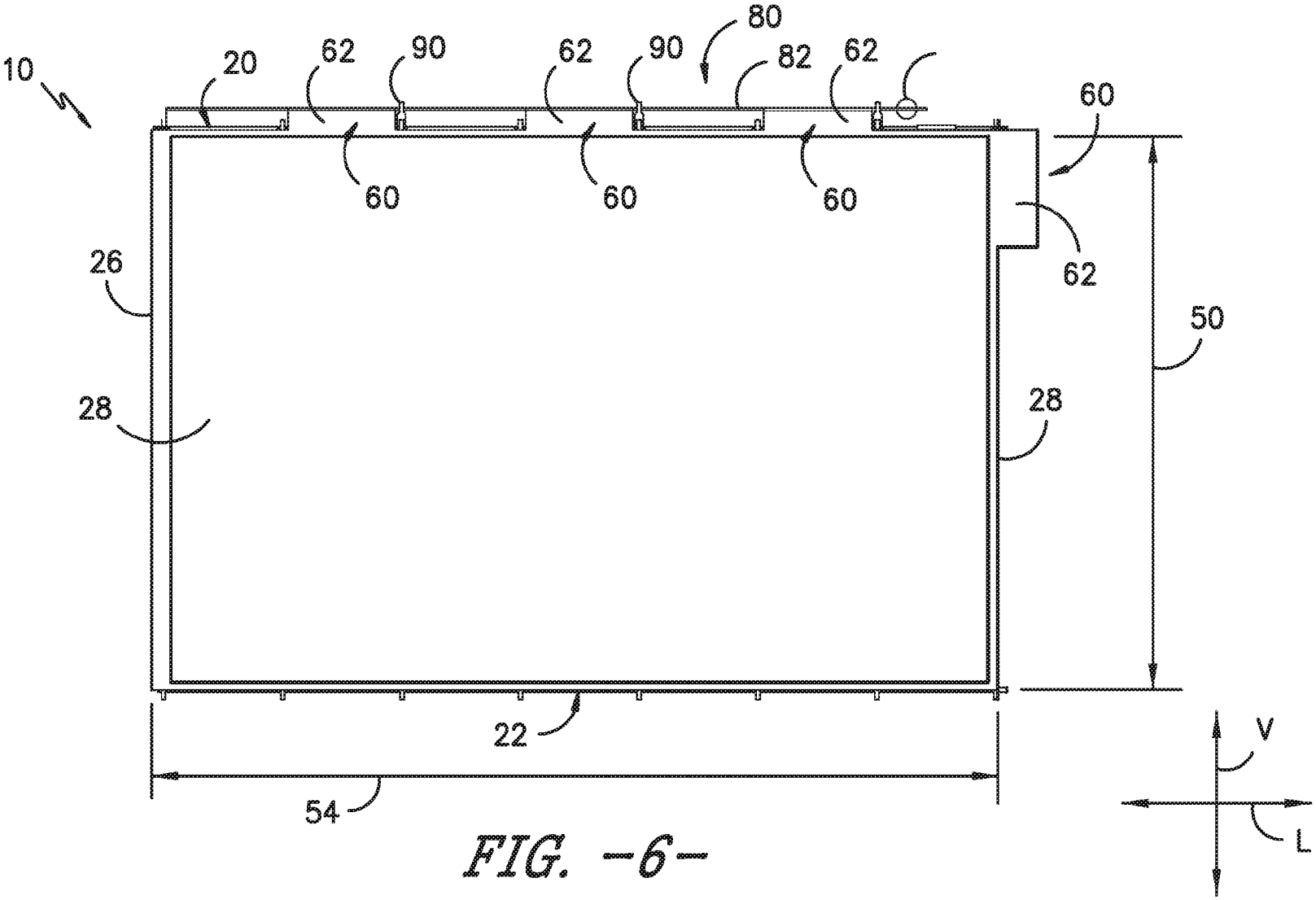
FIG. 6 is a rear view of a collapsible shipping container in an expanded position in accordance with embodiments of the present disclosure.
Figure 7:
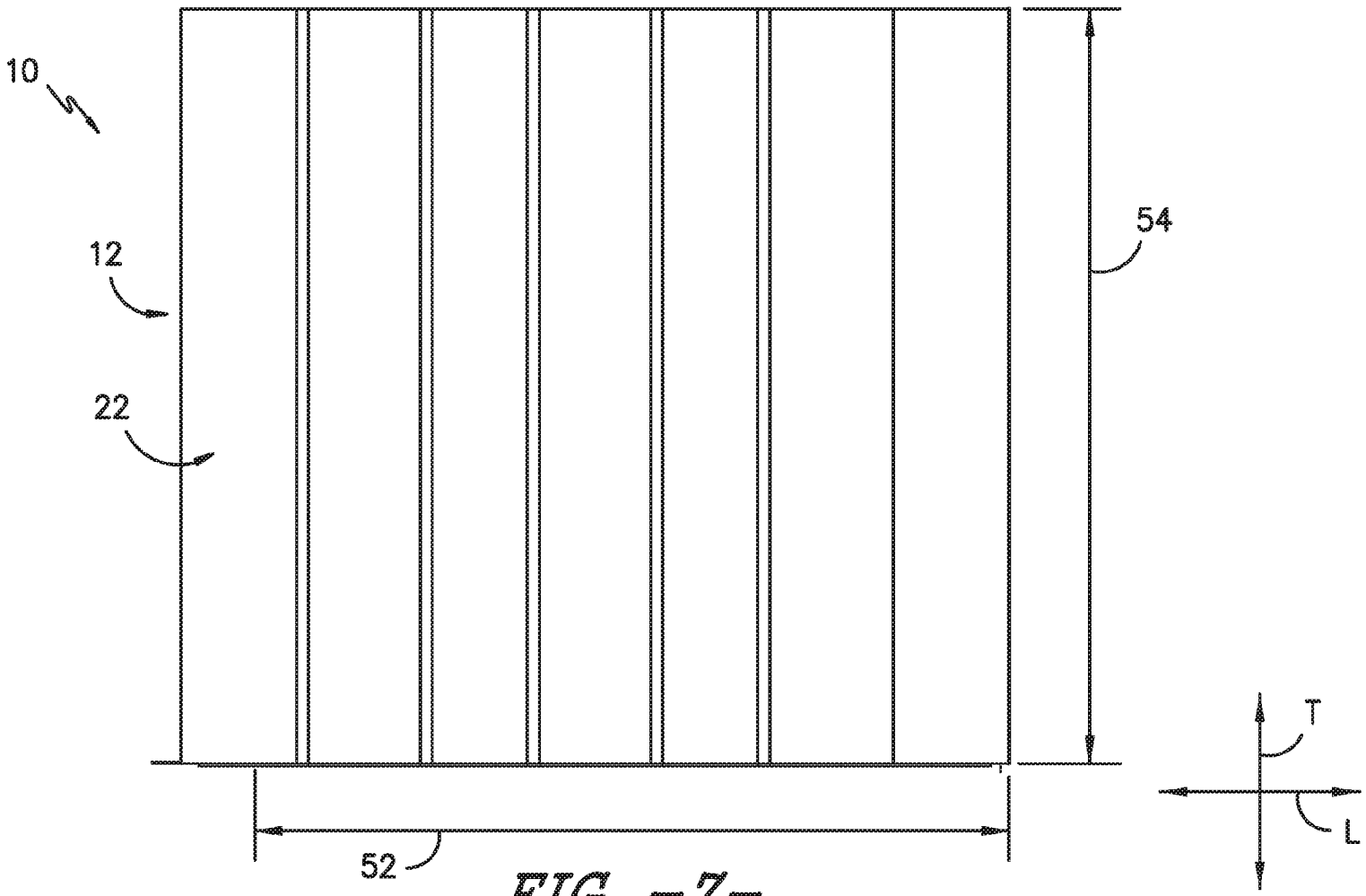
FIG. 7 is a bottom view of a collapsible shipping container in an expanded position in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, a collapsible shipping bag in accordance with the present disclosure includes a body which is divided into a plurality of pockets. Body can include outer walls and inner stiffener panels which define the pockets. Top and bottom outer walls may each be formed from a plurality of panels which are spaced apart from each other at intersections between the top and bottom outer walls and the inner stiffener panels. One or more straps may be coupled to the body at various intersections (such as alternating intersections) between outer walls and inner stiffener panels, such as via rings connected to the outer body at the intersections and which the straps extend through.

When ends of the straps are pulled towards opposing ends of the straps (such as via a user pulling handles on the ends), the intersections that the straps are coupled to may be moved in a first direction, such as generally upwards, and neighboring panels may thus collapse towards each other. Intersections that the straps are not coupled to may be moved in a second opposing direction, such as generally downwards, and neighboring panels may thus collapse towards each other. Accordingly, the body may collapse in an accordion style. A rear wall of the body may be releasable at least on one end to allow this collapse, and the rear wall may then fold onto a side wall. The rear wall may be releasably connected to one or more of the side walls and top and bottom walls (such as via a hook-and-look fastener assembly such as a VELCRO assembly), and may be fixedly and rotatably connected to one of the side walls and top and bottom walls (such as one of the side panels as shown).

Referring now to FIGS. 1 through 12, embodiments of a collapsible shipping bag 10 in accordance with the present disclosure are provided. Bag 10 includes a body 12 which defines an interior 14. The body 12 may, for example, include a top wall 20 and bottom wall 22. The body 12 may further include, for example, a right sidewall 24 and a left sidewall 26. The body 12 may further include, for example, a rear wall 28. The bottom wall 22 may be spaced apart from the top wall 20 along a vertical axis V, and may thus be below the top wall 20 along the vertical axis V. The sidewalls 24, 26 may each extend between the top wall 20 and bottom wall 22. The left sidewall 26 may be spaced apart from the right sidewall 24 along a longitudinal axis L. As shown, body 12 in exemplary embodiments may have a generally cubic shape.

Notably, the vertical axis V and longitudinal axis L, along with a transverse axis T, may be mutually orthogonal, thus defining a coordinate system.

The top wall 20 and bottom wall 22 may each include a plurality of internal panel members 30 which are disposed within an outer cover 32. The internal panel members 30 may generally provide rigidness to portions of the top wall 20 and bottom wall 22. The right and left sidewalls 24, 26 and rear wall 28 may additionally each include one or more internal panel members which are disposed within an outer cover. In exemplary embodiments as shown, only a single internal panel member is utilized for the right and left sidewalls 24, 26 and rear wall 28.

The internal panel members 30 may be formed from suitable stiffening materials and in suitable stiffening configurations. For example, internal panel members 30 may be formed from cardboard, wood, plastic, or other suitable relatively rigid materials. Further, internal panel members 30 may include corrugation, honeycomb, laminate, or other suitable stiffening features. Outer covers 32 may be formed from suitable plastics or other flexible materials.

Bag 10 may further include a plurality of inner stiffener panels 40. Each inner stiffener panel 40 may, for example, include one or more internal panel members which are disposed within an outer cover. In exemplary embodiments as shown, only a single internal panel member is utilized for each inner stiffener panel 40. The inner stiffener panels 40 may be disposed within the interior 14, and may divide the interior 14 into a plurality of pockets 42. For example, as shown, the inner stiffener panels 40 may be positioned between the left and right sidewalls 24, 26, and may be spaced apart along the longitudinal axis L when the bag 10 is in an expanded position.

The bag 10 in exemplary embodiments may be sized to accommodate relatively large components such as automotive components, i.e. doors, etc. Each component may be housed in a pocket 42 when the bag 10 is in an expanded position. Accordingly, a height 50 (along vertical axis V), a width 52 (along longitudinal axis L) and a depth 54 (along transverse axis T) may be defined for the bag 10 in the expanded position. The height 50, for example, may in exemplary embodiments be greater than 24 inches, such as greater than 28 inches, such as greater than 30 inches, such as between 24 and 36 inches, such as between 28 and 32 inches. The width 52, for example, may in exemplary embodiments be greater than 48 inches, such as greater than 54 inches, such as greater than 60 inches, such as between 48 and 72 inches, such as between 54 and 66 inches. The depth 54, for example, may in exemplary embodiments be greater than 30 inches, such as greater than 34 inches, such as greater than 38 inches, such as between 30 and 48 inches, such as between 34 and 44 inches. Notably, while the depth 54 and height 50 may remain constant, the width 52 in exemplary embodiments may be substantially reduced when the bag 10 is moved from an expanded position to a collapsed position. For example, in the collapsed position, the width 52 may be less than 24 inches, such as less than 18 inches, such as less than 12 inches.

In exemplary embodiments, each inner stiffener panel 40 may have a depth that is approximately equal to the depth 54. Alternatively, the depths of the inner stiffener panels 40 may be less than depth 54. Additionally, in exemplary embodiments the rear wall 28 has a width that is approximately equal to the width 52. Alternatively, the width of the rear wall 28 may be greater than or less than the width 52.

The rear wall 28 may be rotatably connected to one of the sidewalls 24, 26, such as the left sidewall 26 as shown. Accordingly, the rear wall 28 may be rotatable relative to this sidewall 24, 26, such as about the connection point with the sidewall 24, 26. In exemplary embodiments as shown, the connection point may be at a vertical edge of the sidewall 24, 26. The rear wall 28 may thus be rotatable about the vertical axis V.

The rear wall 28 may further be releasably connectable to other walls of the body 12, such as the other sidewall 24, 26 and/or the top wall 20 and/or the bottom wall 22. Such releasable connection may allow the rear wall 28 to be connected to such walls when the bag 10 is in the expanded position during, for example, shipping of components. Further such releasable connection may allow the rear wall 28 to be disconnected from such walls for movement of the bag 10 from the expanded position to the collapsed position.

Various suitable devices may be utilized to facilitate such releasable connections. In exemplary embodiments, hook-and-loop assemblies 60, such as VELCRO assemblies, may be utilized. A hook-and-loop assembly 60 includes a hook portion 62 which includes a plurality of hooks and a loop portion 64 which includes a plurality of loops. When pressed together, the hooks and loops releasably connect together. To facilitate a releasable connection, one of a hoop portion 60 or loop portion 62 may be attached to the rear wall 28, and the other of a hoop portion 60 or loop portion 62 may be attached to another wall, such as wall 20, 22, 24 or 26. Hook-and-loop assembly 60 connections are illustrated on rear wall 28 and top wall 20, and on rear wall 28 and right wall 24.

Alternatively, other suitable devices may be utilized to facilitate such releasable connections, such as zippers, snaps, etc.

As illustrated, each of the plurality of inner stiffener panels 40 extends along the vertical axis V between the top wall 20 and bottom wall 22. The inner stiffener panels 40 are further connected to the top wall 20 and bottom wall 22, such as at various intersections that are defined by such connections. Each stiffener panel 40 may define an intersection with the top wall 20 and the bottom wall 22. The intersections are generally the locations where the stiffener panel 40 contacts the top wall 20 and bottom wall 22. Notably, the internal panel members 30 of the top and bottom wall 20, 22 may be disposed between the intersections, and may generally not cross or otherwise impede the intersections.

As discussed herein, the intersections may be divided into various groups of intersections depending on their movement during movement of the bag 10 from the expanded position to the collapsed position. For example, a first plurality of intersections 72 with the top wall 20 and a first plurality of intersections 74 with the bottom wall 22 may be defined for various stiffener panels 40 in a first plurality of stiffener panels 40. A second plurality of intersections 76 with the top wall 20 and a second plurality of intersections 78 with the bottom wall 22 may be defined for various other stiffener panels 40 in a second plurality of stiffener panels 40.

In exemplary embodiments, the stiffener panels 40 of the first and second pluralities may be disposed in an alternating arrangement as shown. Accordingly, the intersections 72 and 76 may be disposed in an alternating arrangement and the intersections 74 and 78 may be disposed in an alternating arrangement. In an alternating arrangement, intersections 72 are between neighboring intersections 76 and intersections 76 are between neighboring intersections 72 (with the exceptions of end intersections 72 and/or 76 which only include a neighboring other intersection 76 or 72 on one side). Similarly, intersections 74 are between neighboring intersections 78 and intersections 78 are between neighboring intersections 74 (with the exceptions of end intersections 74 and/or 78 which only include a neighboring other intersection 78 or 74 on one side). Accordingly, stiffener panels 40 of the first plurality are between neighboring stiffener panels 40 of the second plurality and stiffener panels 40 of the second plurality are between neighboring stiffener panels 40 of the first plurality (with the exceptions of end stiffener panels 40 of the first plurality and/or second plurality which only include a neighboring other stiffener panels 40 of the second plurality or first plurality on one side).

Alternatively, other suitable arrangements of the stiffener panels 40 and intersections may be utilized.

As further illustrated, a bag 10 in accordance with the present disclosure may include one or more straps 80 which may be independent from or connected to each other. Each strap 80 may include a strap body 82 and a handle 84 which is disposed at an end of the strap body 82. In some embodiments as illustrated in FIGS. 1 through 7, a single handle 84 connects two strap bodies 82. In other embodiments as illustrated in FIGS. 8 through 12, each individual strap 80 includes a separate handle 84 connected to a strap body 82.

Each strap 80 is coupled to the body 12 of the bag 10, and movement of the straps 80 may facilitate movement of the bag 10 from the expanded position to the collapsed position. For example, each strap 80 may be coupled to the body 12 at each of first intersection 82 with the top wall 20. Notably, such coupling may be a movable coupling, such that the strap 80 is movable relative to the first intersections 82. For example, in exemplary embodiments, bag 10 may include a plurality of rings 90. Each ring 90 may be connected to the body 10 at a first intersection 10. A strap 80, such as the strap body 82 thereof, may extend through rings 90 to couple the strap 80 to the body 12.

Notably, straps 80 may be uncoupled from the second intersections 74. Such coupling with the first intersections 72 and uncoupling from the second intersections 74 may advantageously facilitate the desired movement of the bag 10 from the expanded position to the collapsed position as discussed herein.

Figure 8:
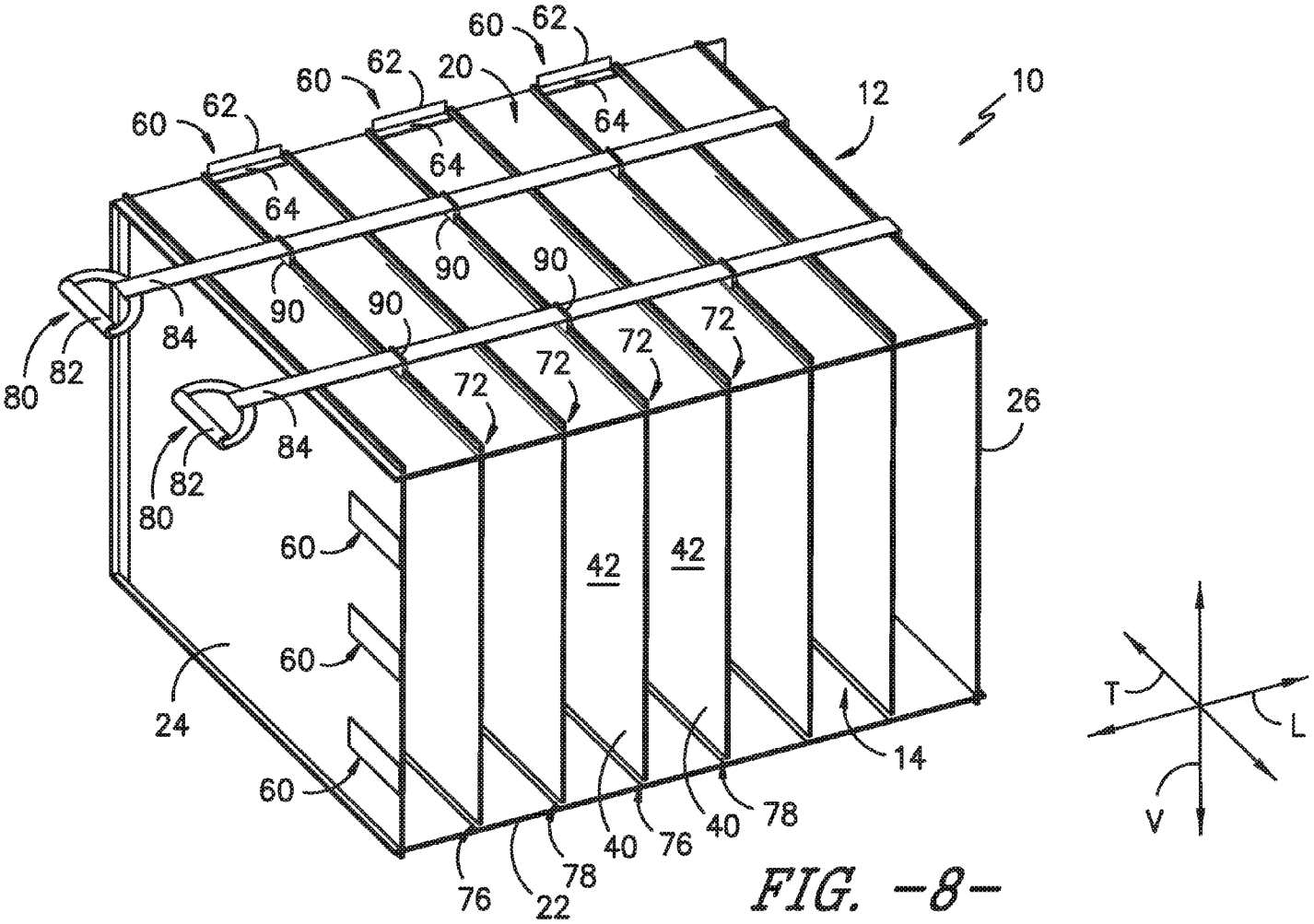
FIG. 8 is a perspective view of a collapsible shipping container in an expanded position in accordance with embodiments of the present disclosure.
Figure 9:
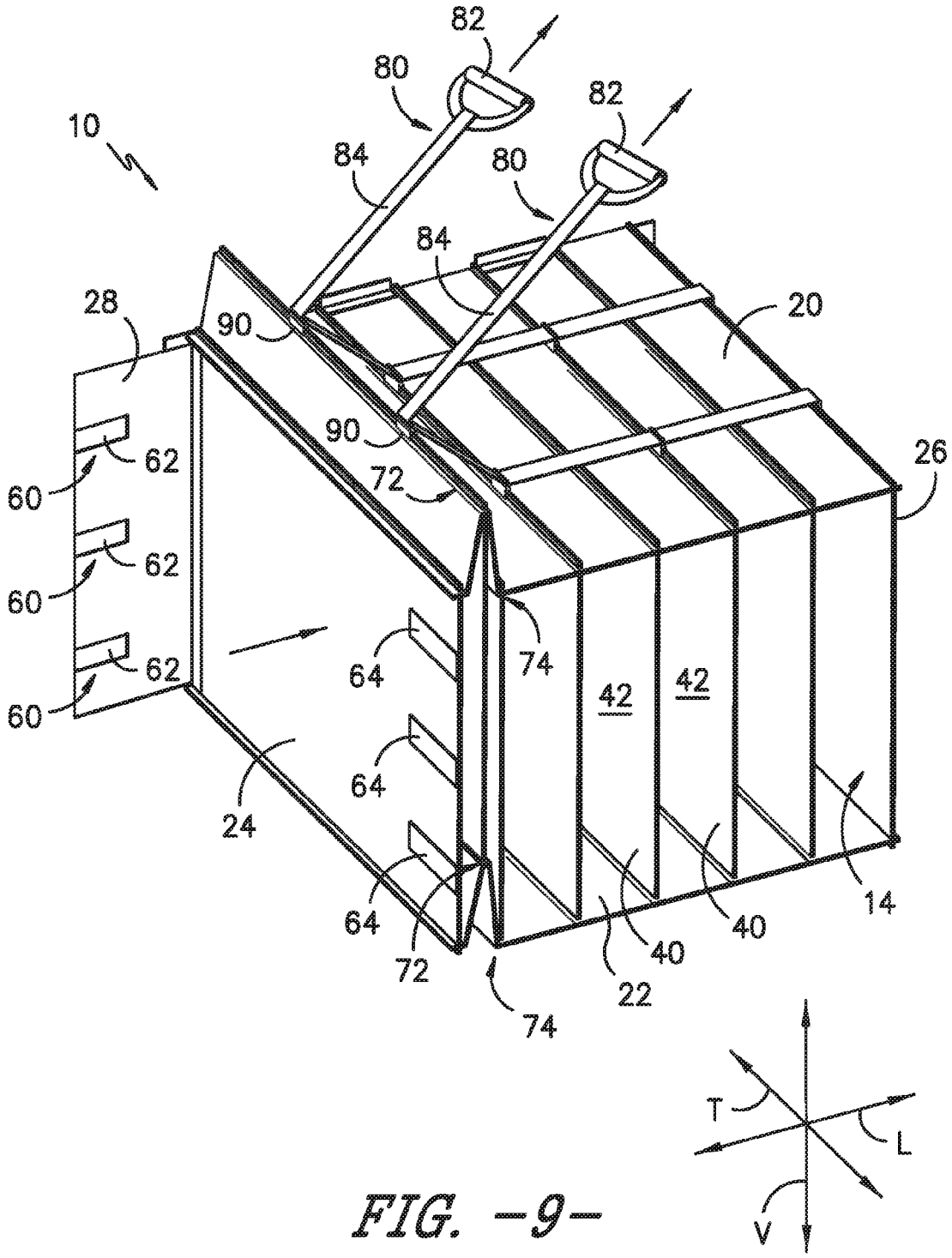
FIG. 9 is a perspective view of a collapsible shipping container being moved from an expanded position to a collapsed position in accordance with embodiments of the present disclosure.
Figure 10:
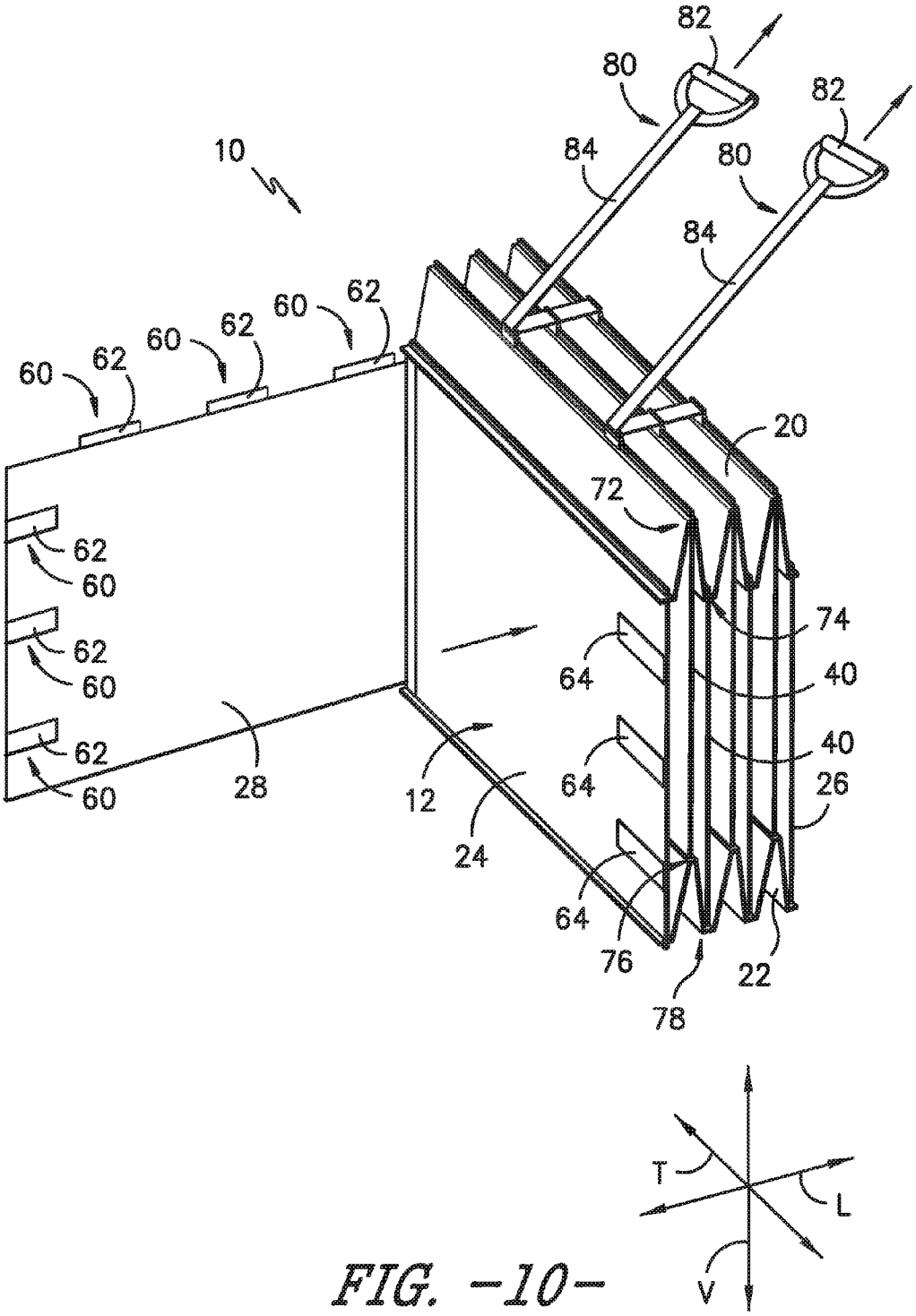
FIG. 10 is a perspective view of a collapsible shipping container being further moved from an expanded position to a collapsed position in accordance with embodiments of the present disclosure.
Figure 11:
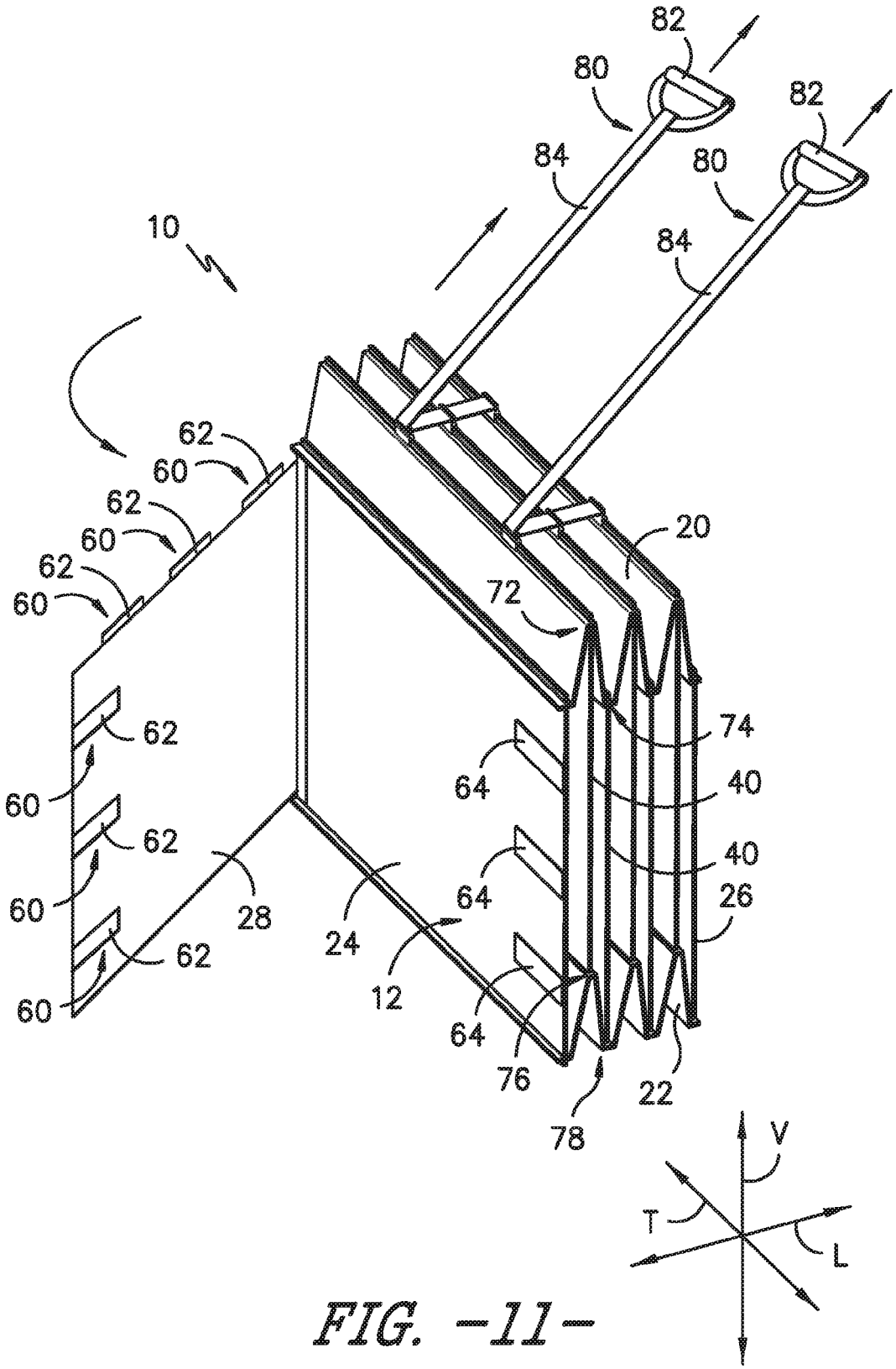
FIG. 11 is a perspective view of a collapsible shipping container in a collapsed position during rotation of a rear wall in accordance with embodiments of the present disclosure.
Figure 12:
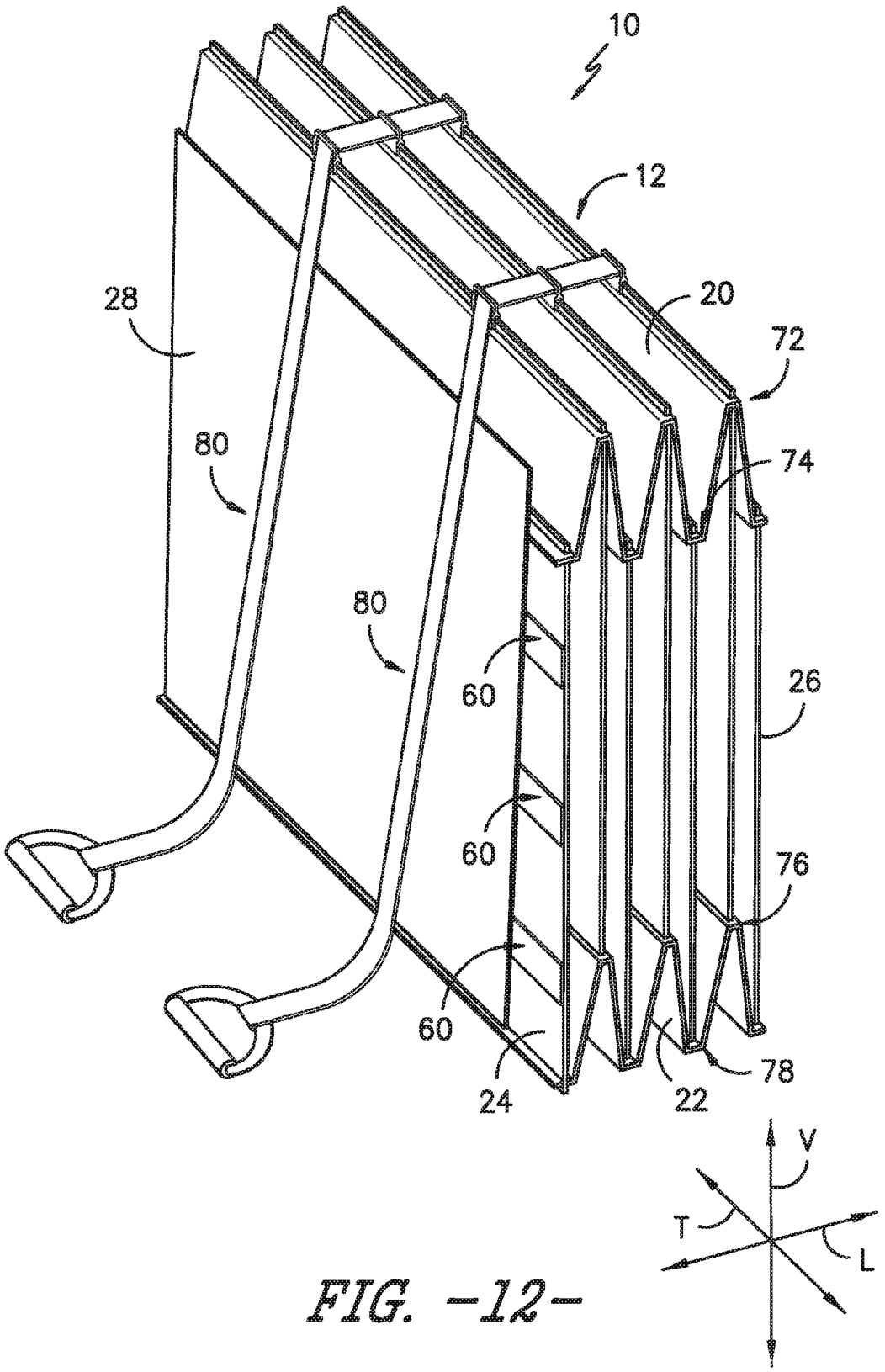
FIG. 12 is a perspective view of a collapsible shipping container in a collapsed position in accordance with embodiments of the present disclosure.

FIGS. 8 through 12 illustrate movement of a bag 10 in accordance with the present disclosure from an expanded position (FIG. 8) to a collapsed position (FIGS. 11 and 12). Methods for collapsing a shipping bag 10 in accordance with the present disclosure may thus include, in some embodiments, releasing the connection of the rear wall 28 to various other walls such as the top wall 20 and right sidewall 24, as illustrated in FIG. 8. A method may further include moving the first plurality of intersections 72 in a first direction (such as upward) along the vertical axis V, as illustrated in FIGS. 9 and 10. Such movement may additionally cause movement of the first plurality of intersections 76 and the associated inner stiffener panels 40 in the first direction along the vertical axis. A method may further include moving the second plurality of intersections 74 in a second opposite direction (such as downward) along the vertical axis V, as illustrated in FIGS. 9 and 10. Such movement may additionally cause movement of the second plurality of intersections 78 and the associated inner stiffener panels 40 in the second direction along the vertical axis.

Notably, in exemplary embodiments, movement of the second plurality of intersections 76 is caused by movement of the first plurality of intersections 72. For example, as the first intersections 72 are moved in the first direction, neighboring internal panel members 30 may collapse and fold towards each other. Such collapse may in turn cause movement of the second intersections 74. In exemplary embodiments, the top wall 20 (and bottom wall 22) thus collapses in an accordion folding style.

Movement of the first plurality of intersections 72 and the second plurality of intersections 74, such as in an accordion-style, may cause movement of the bag 10 from the expanded position to the collapsed position. For example, such movement may occur along the longitudinal axis L. As shown, for example, one of the left sidewall 26 or right sidewall 24 (as shown) may move towards the other of the left sidewall 26 (as shown) or right sidewall 24. Accordingly, the bag 10 may move to the collapsed position, which is illustrated in FIGS. 11 and 12.

In exemplary embodiments as shown, movement of the first plurality of intersections 72 is caused by movement of the one or more straps 80. For example, a user may pull the straps 80, such as via the handles 84 thereof, along the longitudinal axis L. Such force on the straps 80 may cause the straps 80 to both move relative to the rings 90 and impart a force on the rings 90 which is transmitted to the first intersections 72, forcing the first intersections 72 in the first direction along the vertical axis V. Such movement in turn may cause movement of the second intersections 74 in the second direction along the vertical axis V. Accordingly, the body may be movable from the expanded position to the collapsed position due to movement of the straps 80. Movement of the straps 80 may cause movement of the first plurality of intersections 72 in the first direction along the vertical axis V and movement of the second plurality of intersections 74 in the second opposite direction along the vertical axis V.

In some embodiments when a rear panel 28 is utilized, a method in accordance with the present disclosure may further include, after the bag 10 is in the collapsed position, rotating the rear panel 28 (such as about the vertical axis V), as illustrated in FIG. 11. For example, the rear panel 28 may be rotated into contact with the sidewall with which the rear panel 28 is not rotatably connected, such as the right sidewall 24 as shown. In some embodiments, the rear panel 28 may further be releasably connected to such sidewall. Once the bag 10 is collapsed and, optionally, the rear panel 28 has been rotated, the bag 10 is in the collapsed position and ready for efficient storage, transport, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A collapsible shipping bag, comprising:

a body defining an interior, the body comprising a top wall, a bottom wall, a right sidewall, and a left sidewall, the bottom wall spaced from the top wall along a vertical axis, the right sidewall and left sidewall each extending between the top wall and the bottom wall, the left sidewall spaced from the right sidewall along a longitudinal axis;

a plurality of inner stiffener panels disposed within the interior and dividing the interior into a plurality of pockets, each of the plurality of inner stiffener panels defining an intersection with the top wall and the bottom wall;

a strap coupled to the body at a first plurality of the intersections with the top wall and uncoupled from the body at a second plurality of the intersections with the top wall, wherein the body is movable from an expanded position to a collapsed position due to movement of the straps, and wherein movement of the straps to move the body from the expanded position to the collapsed position causes movement of the first plurality of the intersections in a first direction along the vertical axis and movement of the second plurality of the intersections in a second opposite direction along the vertical axis.

2. The collapsible shipping bag of claim 1, wherein the first plurality of the intersections with the top wall and the second plurality of the intersections with the top wall are disposed in an alternating arrangement such that an intersection of the first plurality of the intersections with the top wall is between neighboring intersections of the second plurality of the intersections and an intersection of the second plurality of the intersections with the top wall are between neighboring intersections of the first plurality of the intersections.

3. The collapsible shipping bag of claim 1, further comprising a plurality of rings, each of the plurality of rings connected to the body at an intersection of the first plurality of the intersections with the top wall, and wherein the strap extends through each of the plurality of rings.

4. The collapsible shipping bag of claim 1, wherein the strap is a plurality of straps.

5. The collapsible shipping bag of claim 1, wherein the body is movable from the expanded position to the collapsed position along the longitudinal axis.

6. The collapsible shipping bag of claim 1, wherein the body further comprises a rear wall, the rear wall releasably connectable to one of the left sidewall or right sidewall.

7. The collapsible shipping bag of claim 6, wherein the rear wall is rotatably connected to the other of the left sidewall or right sidewall.

8. The collapsible shipping bag of claim 7, wherein the rear wall is rotatable about the vertical axis.

9. The collapsible shipping bag of claim 6, wherein the rear wall is further releasably connectable to the top wall.

10. The collapsible shipping bag of claim 6, wherein the rear wall is releasably connectable via a hook-and-loop fastener assembly.

11. A collapsible shipping bag, comprising:

a body defining an interior, the body comprising a top wall, a bottom wall, a right sidewall, a left sidewall, and a rear wall, the bottom wall spaced from the top wall along a vertical axis, the right sidewall and left sidewall each extending between the top wall and the bottom wall, the left sidewall spaced from the right sidewall along a longitudinal axis, the rear wall releasably connectable to one of the left sidewall or right sidewall and rotatably connected to the other of the left sidewall or right sidewall, the rear wall rotatable about the vertical axis;

a plurality of inner stiffener panels disposed within the interior and dividing the interior into a plurality of pockets, each of the plurality of inner stiffener panels defining an intersection with the top wall and the bottom wall;

a strap coupled to the body at a first plurality of the intersections with the top wall and uncoupled from the body at a second plurality of intersections with the top wall, the first plurality of the intersections with the top wall and the second plurality of the intersections with the top wall disposed in an alternating arrangement, wherein the body is movable from an expanded position to a collapsed position due to movement of the straps, and wherein movement of the straps to move the body from the expanded position to the collapsed position causes movement of the first plurality of the intersections in a first direction along the vertical axis, movement of the second plurality of the intersections in a second opposite direction along the vertical axis, and movement of one of the right sidewall or the left sidewall towards the other of the right sidewall or the left sidewall along the longitudinal axis.

12. The collapsible shipping bag of claim 11, further comprising a plurality of rings, each of the plurality of rings connected to the body at an intersection of the first plurality of the intersections with the top wall, and wherein the strap extends through each of the plurality of rings.

13. The collapsible shipping bag of claim 11, wherein the strap is a plurality of straps.

14. The collapsible shipping bag of claim 11, wherein the rear wall is further releasably connectable to the top wall.

15. The collapsible shipping bag of claim 11, wherein the rear wall is releasably connectable via a hook-and-loop fastener assembly.

16. A method for collapsing a shipping bag, the shipping bag comprising a body defining an interior, the body comprising a top wall, a bottom wall, a right sidewall, and a left sidewall, the bottom wall spaced from the top wall along a vertical axis, the right sidewall and left sidewall each extending between the top wall and the bottom wall, the left sidewall spaced from the right sidewall along a longitudinal axis, the shipping bag further comprising a plurality of inner stiffener panels disposed within the interior and dividing the interior into a plurality of pockets, each of the plurality of inner stiffener panels defining an intersection with the top wall and the bottom wall, the method comprising:

moving a first plurality of the intersections with the top wall in a first direction along the vertical axis; and moving a second plurality of the intersections with the top wall in a second direction opposite the first direction along the vertical axis, wherein movement of the first plurality of the intersections with the top wall and the second plurality of the intersections with the top wall causes movement of one of the right sidewall or the left sidewall towards the other of the right sidewall or the left sidewall along the longitudinal axis, and wherein movement of the first plurality of the intersections with the top wall is caused by movement of a strap, the strap coupled to the body at the first plurality of the intersections with the top wall and uncoupled from the body at the second plurality of the intersections with the top wall.

17. The method of claim 16, wherein movement of the first plurality of the intersections with the top wall causes movement of the second plurality of the intersections with the top wall.

18. The method of claim 16, further comprising rotating a rear wall of the body about the vertical axis.

* * * * *